US005221017A

United States Patent [19]

Cistone et al.

[11] Patent Number: 5,221,017

[45] Date of Patent: Jun. 22, 1993

[54] CONTROLLED DROPPER TIP CLOSURE

[75] Inventors: David R. Cistone, Sea Isle; Larry A. Page, Vineland, both of N.J.

[73] Assignee: Wheaton Holding, Inc., Wilmington, Del.

[21] Appl. No.: 959,675

[22] Filed: Oct. 13, 1992

[51] Int. Cl.[5] ..... B65D 47/08; B65D 47/18

[52] U.S. Cl. ..... 215/235; 215/237; 215/344; 220/259; 220/335; 222/420; 222/556

[58] Field of Search ..... 215/235, 237, 238, 239, 215/240, 321, 344; 222/420, 421, 556; 220/259, 335, 339

[56] References Cited

U.S. PATENT DOCUMENTS

| | | | |
|---|---|---|---|
| 2,249,832 | 7/1941 | Hubschman | 222/420 |
| 3,788,549 | 1/1974 | Ostrowsky | 239/309 |
| 4,193,519 | 3/1980 | Dubach et al. | 222/556 X |
| 4,220,248 | 9/1980 | Wilson et al. | 215/235 |
| 4,638,916 | 1/1987 | Beck et al. | 215/235 |
| 4,739,906 | 4/1988 | LoTurco | 222/153 |
| 4,793,501 | 12/1988 | Beck | 215/235 |
| 4,793,502 | 12/1988 | Beck | 215/235 |
| 4,848,612 | 7/1989 | Beck | 215/235 |
| 4,852,770 | 8/1989 | Sledge et al. | 222/153 |
| 4,854,473 | 8/1989 | Dubach | 220/335 |
| 4,863,048 | 9/1989 | Iizuka et al. | 215/235 |
| 4,892,208 | 1/1990 | Sledge | 215/216 |
| 4,915,268 | 4/1990 | Lay et al. | 222/556 X |
| 5,007,555 | 4/1991 | Beck | 220/339 |
| 5,065,876 | 11/1991 | Joyce | 215/206 |
| 5,067,624 | 11/1991 | Thanisch | 215/235 |
| 5,076,474 | 12/1991 | Hansen | 222/420 |
| 5,078,296 | 1/1992 | Amidzich | 220/335 |
| 5,096,077 | 3/1992 | Odet et al. | 215/211 |
| 5,105,993 | 4/1992 | LaHaye et al. | 222/420 X |
| 5,143,234 | 9/1992 | Lohrman et al. | 215/235 |
| 5,148,912 | 9/1992 | Nozawa | 220/339 |

*Primary Examiner*—Stephen P. Garbe
*Assistant Examiner*—Vanessa Caretto
*Attorney, Agent, or Firm*—Ratner & Prestia

[57] ABSTRACT

A unitary closure assembly having a cap body that has an upper portion with a substantially conical drop dispensing tip including a ringed protrusion disposed around the base of said tip, and a lower portion that can be secured to an opening in a container. The cap body has a lid secured to it by a hinge. The lid comprises a substantially conical raised portion that is adapted to enclose and cover the drop dispensing tip on the cap body. The lid has a raised ring disposed on its inner side which seals the opening in the drop dispensing tip, and a ringed depression in the inner side which mates with the ringed protrusion on the drop dispensing tip.

7 Claims, 1 Drawing Sheet

CONTROLLED DROPPER TIP CLOSURE

BACKGROUND OF THE INVENTION

This invention relates generally to closure assemblies for containers, and more particularly, to a closure assembly which has a drop dispensing tip, a lid which snaps open and closed over the drop dispensing tip, and two seals, one for preventing accidental dispensation or seepage of the contents of the container, and one for securing the lid over the drop dispensing tip.

Container closure assemblies having drop dispensing tips are known. A typical example of such a closure assembly appears in U.S Pat. No. 3,788,549 to Ostrowsky. There, a closure assembly is disclosed having a nozzle portion that attaches to the opening of a container. The nozzle has an upwardly extending tubular portion that functions as a pouring spout. A lid adapted to cover the spout is attached to the nozzle portion by a flexible hinge. Because the hinge of this device is flexible, however, it has no fixed, rigid position. In use, therefore, having opened the spout by disengaging the lid from its closed position over the spout, the user is generally required to restrain the lid manually from the spout in order to dispense the contents of the container through the spout. Also, when the lid is to be returned to the closed position, the user must manually guide the lid into position over the spout. Because the user is usually holding the container in one hand while manipulating the lid in this manner with the other hand, opening, dispensing from, and closing this known dropper tip closure assembly is generally a two-handed operation. Other typical examples of known dropper tip closure assemblies appear in U.S. Pat. Nos. 4,739,906 to LoTurco and 5,076,474 to Hansen. The closure assemblies disclosed in these patents also usually require two-handed operation.

In many applications of dropper tip closure assemblies, the necessity of two-handed operation is a significant drawback. For example, with contact lens cleaning solutions, where the solution is dispensed from a container equipped with one of the known dropper tip closures, the user frequently must set the lens down while opening, dispensing from, or closing the closure assembly, or leave the container open during the cleaning operation. It is thus desirable for a user to hold the lens in one hand and apply the solution with the other, manipulating the container and the closure assembly with just one hand. There are numerous other applications for dropper tip closures in which two-handed operation is a drawback. A dropper tip closure assembly facilitating one-handed operation is thus desirable.

Also desirable is a dropper tip closure assembly that minimizes seepage and accidental dispensation of the contents of the container, and that has means for securing the lid in a closed position over the drop dispensing tip.

To the extent that a snap-type hinge is used in the present invention, it is relevant to note that snap-type hinges are known. Typical examples appear in U.S. Pat. Nos. 5,007,555 to Beck and 4,863,048 to Iizuka et al. These snap-type hinges allow one-touch operation for opening and closing, and they hold the lid back away from the cap body in the open position so that the contents of the container can be dispensed.

SUMMARY OF THE INVENTION

The present invention provides a unitary closure assembly having a cap body that has an upper portion with a circular peripheral base surface and a substantially conical drop dispensing tip raised from the base surface, the drop dispensing tip having an opening at the apex thereof and a ringed protrusion disposed around the base of said tip, and a lower portion that can be secured to an opening in a container. The cap body has a lid secured to it by a hinge, the lid having an inner side and an outer side, and having a circular peripheral base portion and a substantially conical raised portion, projecting from the base portion, that is adapted to enclose and cover the drop dispensing tip on the cap body. The lid has a raised ring disposed on its inner side around the apex of the raised portion, the raised ring adapted to seal the opening in the drop dispensing tip, the lid also having a ringed depression in the inner side of the raised portion proximate to the base portion, adapted to mate with the ringed protrusion on the drop dispensing tip to retain them in sealing engagement. The hinge has one end integral with the cap body and an opposite end integral with the lid, and comprises two side connectors and a central resilient member. The resilient member is deformed when the cap is intermediate a fully opened or fully closed position, thus biasing the cap toward one of those two positions. This facilitates one-handed manipulation of the container and the closure.

In the preferred embodiment of this invention, the hinged lid and cap body are made of a strong resilient plastic, such as polypropylene, polyethylene, polyvinyl chloride, polystyrene, polyester, or combinations thereof, and the lower portion of the cap body contains a threaded bore or other engaging configuration therein for attaching the closure to a container.

DETAILED DESCRIPTION OF THE INVENTION

Figure 1:
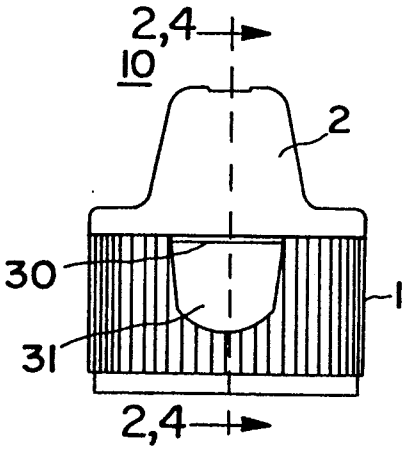
FIG. 1 is a side view of one embodiment of the closure of the present invention, showing the lid in the closed position over the drop dispensing tip on the cap body.

Referring to the exemplification of the invention shown in FIG. 1, a closure assembly 10 includes a cap body 1 and a hinged lid 2, preferably formed in one piece, which can be molded from a strong resilient plastic, such as polypropylene. Lid 2 preferably includes a tab 30 extending beyond the perimeter of lid 2, and, in the closed position, extending over a facet 31, which can be curved or flat, formed on cap body 1. Tab 30 facilitates opening lid 2.

Figure 4:
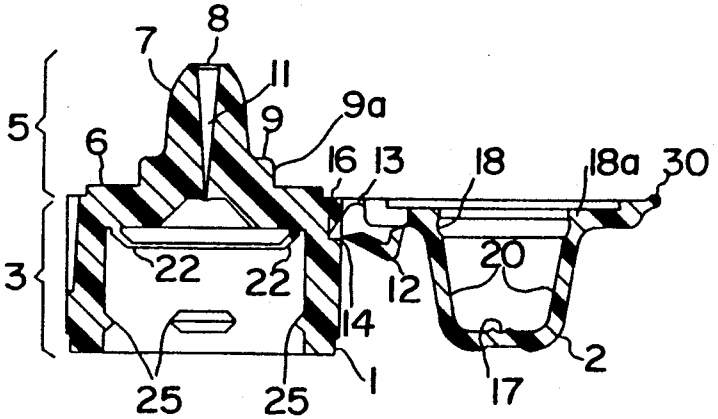
FIG. 4 is a cross-sectional view, in the plane 2,4—2,4 of an alternate embodiment of the closure present invention, with the lid in the open position.
Figure 2:
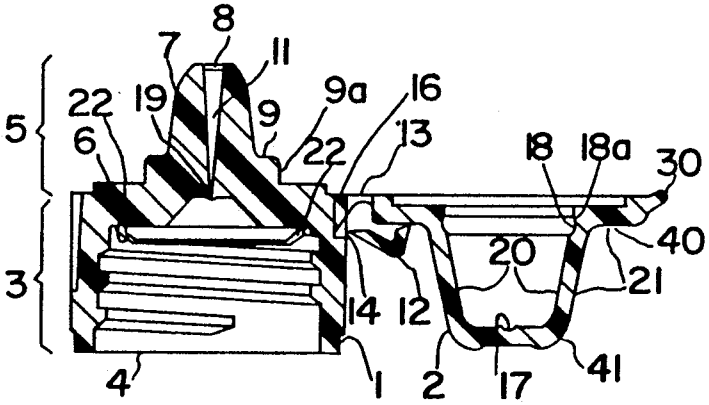
FIG. 2 is a cross-sectional view, in the plane 2,4–2,4 of the embodiment shown in FIG. 1, with the lid in the open position.

As seen in FIG. 2, cap body 1 includes a lower portion 3 having a threaded bore 4 therein for attaching closure assembly 10 to a container (not shown). FIG. 4 shows an alternate design including a retaining bead or beads 25 which engage a corresponding bead on a container (not shown). Other methods, well known to those skilled in the art, can also be employed to attach cap 10 to a container. Cap body 1 includes an upper portion 5 and a lower portion 3. Upper portion 5 includes a peripheral base 6, which is preferably circular, and a substantially conical drop dispensing tip 7 projecting from base 6. Tip 7 has an opening 8 formed at the apex thereof, and a ringed protuberance (or shoulder) 9 formed annularly around tip 7, preferably near the base of tip 7, as shown. Opening 8 in tip 7 is in fluid communication with threaded bore 4 or retaining beads 25 by means of duct 11 and aperture 19 formed in tip 7. Threaded bore 4 or retaining beads 25, also include flanges 22 which seal against a container with which the closure is to be used.

Lid 2 comprises an inner side 20 and an outer side 21. Lid 2 has a peripheral base portion 40, which is preferably circular, and a raised portion 41 projecting (downwardly in the inverted position of lid 2 shown in FIG. 2) from base portion 40. Raised portion 41 is preferably cone or frustum shaped, but regardless of its shape, raised portion 41 is adapted to enclose and cover completely tip 7. The inner side 20 of raised portion 41 is shaped such that, as lid 2 is snapped closed, tip 7 of cap body 1 extends into raised portion 41 without interfering with the closing of lid 2. Because of this, a snug fit between all of raised portion 41 and tip 7 cannot usually be achieved. Therefore raised portion 41 and tip 7 cannot seal all along the interior of raised portion 41.

To overcome this problem, lid 2 includes a raised ring 17 disposed on inner side 20 of lid 2. When lid 2 is closed over tip 7, ring 17 mates with the upper surface of tip 7 and seals around opening 8, preventing accidental dispensing or seepage of the contents of the container. To secure this sealing engagement, lid 2 also includes a ringed or annular depression 18 in the inner side of lid 2 near the base of raised portion 41. When lid 2 is closed over tip 7, depression 18 in lid 2 mates with protrusion 9 on tip 7, locking lid 2 in place on cap body 1 thus retaining ring 17 in sealing engagement with the top outer surface of tip 7 surrounding opening 8. To best effect this secure engagement, ring 9 and depression 18 include mating axial concave 18*a* (in the case of depression 18) and convex 9*a* (in the case of ring 9) which mate when lid 2 is closed over tip 7.

The axial proximity of ring 9 to sealing ring 17 is important also to effect sealing engagement of tip with lid 2 in order to minimize leakage.

Figure 3:
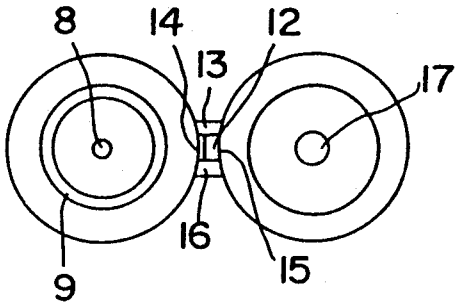
FIG. 3 is a top view of the closure shown in FIG. 1 in its open position.

Lid 2 is hinged to cap body 1 by a snap-type hinge. The snap-type hinge comprises resilient hinge piece 12, hinge connectors 13 and 16, and hinge points 14 and 15, all as shown in FIGS. 2 and 3. As lid 2 is moved from an open position (as shown in FIGS. 2 and 3) to a closed position (as shown in FIG. 1), hinge connectors 13 and 16 bend toward cap body 1, forcing lid 2 over tip 7. Meanwhile, the distance between hinge point 15 and hinge point 14 increases, deforming resilient hinge piece 12. After reaching the midpoint between fully open and fully closed, the distance between hinge points 14 and 15 begins to decrease, and resilient hinge piece 12 pulls (or snaps) lid 2 closed (although the lid must usually be sealed by further pressure to seat protrusion 9 in depression 18). Similarly, in opening lid 2, resilient hinge piece 12 is deformed (stretched) until the midpoint between fully closed and fully open is reached, after which resilient hinge piece 12 pulls lid 2 to the fully open position, snapping the lid open. Resilient hinge piece 12 will retain lid 2 in a fully open position until pressure is applied to close the lid.

The closure of the present invention finds significant application in the pharmaceutical field. A user desirous of dispensing the contents of a container equipped with the dropper tip closure of the present invention can open the lid with one hand while holding the container in the same hand. The lid is thus snapped open to expose the dropper tip. While the contents of the container are being dispensed, the lid is held away from the tip by the snap-type hinge, relieving the user of the need to manually restrain the lid from the tip. After dispensing, and still with just one hand, the user can snap the lid closed over the tip. There is no need for the user to manually guide the lid over the tip. Once closed, the lid seals the opening in the tip, preventing accidental dispensing of the contents. The lid also forms a second seal with the cap body (e.g. at the top surface of base 6 as seen in FIG. 2), securing the lid in place over the tip. In this way, maintaining sterility of the contents of the container is facilitated. The lid need not be set down on a surface, and thereby contaminated. Further, the lid need not be grasped or aligned with the dropper tip, thereby also risking contamination.

The configuration of the dropper tip, the opening in the dropper tip, and the duct in the dropper tip can be varied to provide different drop sizes depending on viscosity and other properties of the substance to be dispensed. Additionally, the configuration of the ringed protuberance on the tip and the depressed ring in the lid can be varied to yield the desired force required to open and lock closed the lid.

While this invention has been described with reference to a specific embodiment, it is not necessarily limited thereto. Accordingly, the appended claims should be construed to encompass not only those forms and embodiments of the invention specifically described above, but to such other forms and embodiments as may be devised by those skilled in the art without departing from its true spirit and scope.

What is claimed:

1. A unitary closure assembly comprising:

(a) a cap body having upper and lower portions, said upper portion comprising a circular peripheral base surface and a substantially conical drop dispensing tip projecting from said base and having an apex, said drop dispensing tip having an opening at the apex thereof and a ringed protrusion disposed around the base of said tip; said lower portion of said cap body adapted to be secured to an opening in a container;

(b) a lid secured to said cap body by a hinge, said lid having an inner side and an outer side, and comprising a circular peripheral base portion and a substantially conical raised portion projecting from said base portion and having an apex, said raised portion adapted to enclose and cover said drop dispensing tip on said cap body; said lid having a raised ring disposed on said inner side around the apex of said raised portion, said raised ring adapted to surround and seal said drop dispensing tip opening; and said lid having a ringed depression in said inner side of said raised portion, proximate said base portion, adapted to mate with said ringed protrusion on said drop dispensing tip and to retain said raised ring in sealing engagement with said tip;

(C) said hinge comprising two side connectors, each secured to said cap body and lid, and a central resilient member also secured to said cap body and lid having a predetermined shape, and being deformed when said lid is in a position intermediate a fully opened or fully closed position.

2. A unitary closure assembly as claimed in claim 1 wherein said lower portion of said cap body has a threaded bore therein.

3. A unitary closure assembly as claimed in claim 1 wherein said lower portion of said cap body has a retaining bead therein.

4. A unitary closure assembly as claimed in claim 1 wherein said closure is formed from polypropylene.

5. A unitary closure assembly as claimed in claim 1 wherein said closure is formed from polyethylene.

6. A unitary closure assembly as claimed in claim 1 wherein said closure is formed from polyvinyl chloride.

7. A unitary closure assembly as claimed in claim 3 wherein said closure is formed from polypropylene.

* * * * *